US006811637B2

(12) United States Patent
Pelagatti et al.

(10) Patent No.: US 6,811,637 B2
(45) Date of Patent: Nov. 2, 2004

(54) PROCESS AND DEVICE FOR PICKING UP MATERIALS

(75) Inventors: Pietro Pelagatti, Sambuceto di San Giovanni Teatino (IT); Giancarlo Casuscelli, Pescara (IT)

(73) Assignee: Fameccanica.Data S.p.A., Chieti (IT)

( * ) Notice: Subject to any disclaimer, the term of this patent is extended or adjusted under 35 U.S.C. 154(b) by 12 days.

(21) Appl. No.: 10/101,713

(22) Filed: Mar. 21, 2002

(65) Prior Publication Data

US 2003/0015296 A1 Jan. 23, 2003

(30) Foreign Application Priority Data

Jul. 20, 2001 (EP) ..... 01830490

(51) Int. Cl.[7] ..... B65H 21/00

(52) U.S. Cl. ..... 156/159; 156/157; 156/502; 156/504; 156/267; 156/523; 242/553

(58) Field of Search ..... 156/157, 159, 156/304.1, 304.3, 502, 504, 267, 523, 516, 564, 569, 570, 573, DIG. 31, 285; 242/553

(56) References Cited

U.S. PATENT DOCUMENTS

| | | | | | |
|---|---|---|---|---|---|
| 4,842,660 | A | * | 6/1989 | Voltmer et al. | 156/64 |
| 4,881,695 | A | * | 11/1989 | Beisswanger | 242/556.1 |
| 5,064,488 | A | * | 11/1991 | Dickey | 156/159 |
| 5,071,503 | A | * | 12/1991 | Berman | 156/250 |
| 5,322,230 | A | | 6/1994 | Dylla et al. | 242/58.5 |
| 5,330,125 | A | | 7/1994 | Dylla | 242/562 |
| 5,405,482 | A | * | 4/1995 | Morrissette et al. | 156/364 |
| 5,501,763 | A | * | 3/1996 | Ueda et al. | 156/504 |
| 5,639,332 | A | * | 6/1997 | Instance | 156/248 |
| 5,853,141 | A | * | 12/1998 | Heiber et al. | 242/552 |
| 5,902,448 | A | * | 5/1999 | Stettner | 156/510 |
| 5,938,890 | A | * | 8/1999 | Schlinkmann et al. | 156/541 |
| 6,500,288 | B2 | * | 12/2002 | Hara et al. | 156/159 |
| 6,582,547 | B1 | * | 6/2003 | Gebekken et al. | 156/256 |
| 6,640,865 | B1 | * | 11/2003 | Morikawa | 156/542 |
| 2002/0189746 | A1 | * | 12/2002 | Kuta et al. | 156/157 |

FOREIGN PATENT DOCUMENTS

| | | |
|---|---|---|
| DE | 4236691 A1 | 5/1994 |
| EP | 1013585 A1 | 6/2000 |

OTHER PUBLICATIONS

European Search Report dated Jan.4, 2002 in European Patent Application No. 01830490.

* cited by examiner

*Primary Examiner*—Mark A. Osele
(74) *Attorney, Agent, or Firm*—Roylance, Abrams, Berdo & Goodman, L.L.P.

(57) ABSTRACT

A source for supplying lengths of adhesive tape applies such adhesive elements with their outer surfaces facing outwards onto a gripping element consisting of a rotating drum. The drum in question applies the adhesive element on the outer surface of a reel of web material in such a way as to establish adhesive connection with the latter. As a result of a subsequent movement of the drum with respect to the reel, there is formed a loop of web material. Since the loop is separate from the reel, it can undergo a cutting action with the consequent formation of a free flap that can be used for unreeling the web material from the reel. After the web material has been unreeled for a certain stretch and the portion on which the aforesaid adhesive element was applied has been eliminated, on the same web material there may be applied a further adhesive element which is left uncovered for at least part of its surface provided with adhesive. The said further adhesive element is used for connecting the free leading end of the web material thus formed with the tail part of a web of homologous material coming from a reel which is in the process of running out, in the execution of a typical "fly-change" operation.

40 Claims, 8 Drawing Sheets

PROCESS AND DEVICE FOR PICKING UP MATERIALS

The present invention relates to techniques for picking up materials, namely techniques that enable a material to be picked up, i.e., gripped, by acting on the surface thereof.

The invention has been developed with particular attention paid to its possible application to the picking-up of web material wound in reels, above all in plants and systems for the fabrication of hygienic and sanitary products, such as nappies, diapers, incontinence pads, sanitary pads, etc. Reference to this specific field of application must not, however, be interpreted as in any way limiting the scope of the invention, which is altogether general and which can extend, for example, in a particularly advantageous way, to plants and systems for automatic packaging.

In the applicational contexts referred to above, there is generally the need to pick up web materials from reels on which the said materials are wound.

The corresponding systems are designed to operate at increasingly higher rates, and consequently the speed of unreeling of the web material tends to increase more and more. In order to ensure continuity of operation, there thus arises the need to perform as rapidly and efficiently as possible the change-over operation, understood as the operation aimed at connecting the tail part or trailing end of a web that is reeled off from a reel that is in the process of running out to a head part or free leading end of a "new" web available on a replacement reel. The above operation must be performed as fast as possible and in such a way that in practice it will be unnoticed by the equipment downstream.

The technical problems involved in meeting the aforesaid need basically fall into two main categories.

One first category is linked to the construction of the jointing or splicing equipment proper, commonly referred to as "splicer".

Another category—closely linked to the previous one—regards the construction of accumulation devices that can reel onto themselves a certain amount of web which is then to be fed to the processing equipment located downstream while the splicing operation is in progress, in static conditions or in conditions of marked deceleraton of the movement of advance of the web.

The corresponding prior art is considerably extensive, as is documented by the vast amount of literature, including patent literature, devoted to the subject. Purely as a reference, the document EP-A-1 013 585 may be cited, which illustrates in detail an accumulation device of the type referred to above.

The invention specifically tackles a problem in a way so to speak complementary to the problems seen previously, namely that of enabling picking-up, i.e., gripping, in a secure and reliable way of a sheet material, the aim being, for example, to enable formation, on a reel of web material, of a free end of the web that can be used for the aforesaid splicing operation (the so-called "flying change") in the terms previously described.

In tackling the above-mentioned problem, numerous factors must be taken into account.

In the first place, the characteristics of the materials that are to be gripped may differ a great deal. Even if we limit our considerations to the sector of hygienic and sanitary articles, the range of materials is extremely wide: from plastic materials, which frequently have a large number of holes or openings (for instance, the perforated film normally used for making the so-called "topsheets" of sanitary pads or diapers), to substantially continuous types of film with surfaces that may be either completely smooth or with a certain degree of surface roughness or microroughness (for example, the types of film used for making the backsheets of the articles referred to above), or yet again to materials having an intrinsically porous nature (such as certain non-woven fabrics or absorbent materials in sheets), and to yet other different materials. It must also be considered that these are frequently materials which are on the whole delicate and hence cannot stand up to high tensile stresses.

For materials wound in reels it is important to take into account factors linked to the characteristics of the reel: diameter, length measured in the axial direction, any possible eccentricity both as regards the path of winding about the core of the reel and as regards any possible warping of the periphery of the reel when the latter is made to turn about its own axis.

There is moreover the specific problem linked to how the free end or flap of the web is fixed to the body of the reel, i.e., whether with a stretch of adhesive tape, possibly applied by hand in a position that is not difficult to foresee, or by local bonding, welding, etc. Clearly, the range of possible situations is very wide.

For this reason, even though the operations of splicing and accumulation described previously are today carried out by resorting for the most part to automatic equipment, the operation of locating the free flap of the "new" reel which is to be used for a splicing operation, as well the operations of preparing the flap in view of the splicing operation are carried out manually by an operator. The corresponding interventions prove critical both on account of the frequency with which they are required (splicing operations between consecutive webs tend in fact to follow one another at ever shorter intervals as the speed of operation of the equipment increases), and on account of the possible consequences of any errors or imprecisions (a delay in preparing the free flap in view of the splicing operation or any error in the preparation of the said flap results in fact, almost inevitably, in the need to stop the equipment).

Consequently, the purpose of the present invention is to provide a solution such as may enable the said operation of picking up and detecting the free end in an altogether automatic way.

In more general terms still, the present invention tackles the problem of providing for gripping of a material, such as a web or sheet material, in a secure and reliable way when the surface characteristics of said material (for instance the fact that it is a perforated or porous material, or else there is the presence of surface roughness) make it difficult to ensure a precise and definite grip on the material, using a device operating by suction, i.e., with a pressure value that is below atmospheric pressure.

According to the present invention, the above purpose is achieved thanks to a process having the characteristics specifically referred to in the ensuing claims. The invention also relates to the corresponding device.

The present invention will now be described, purely by way of non-limiting example, with reference to the attached drawings, in which.

Figure 1:
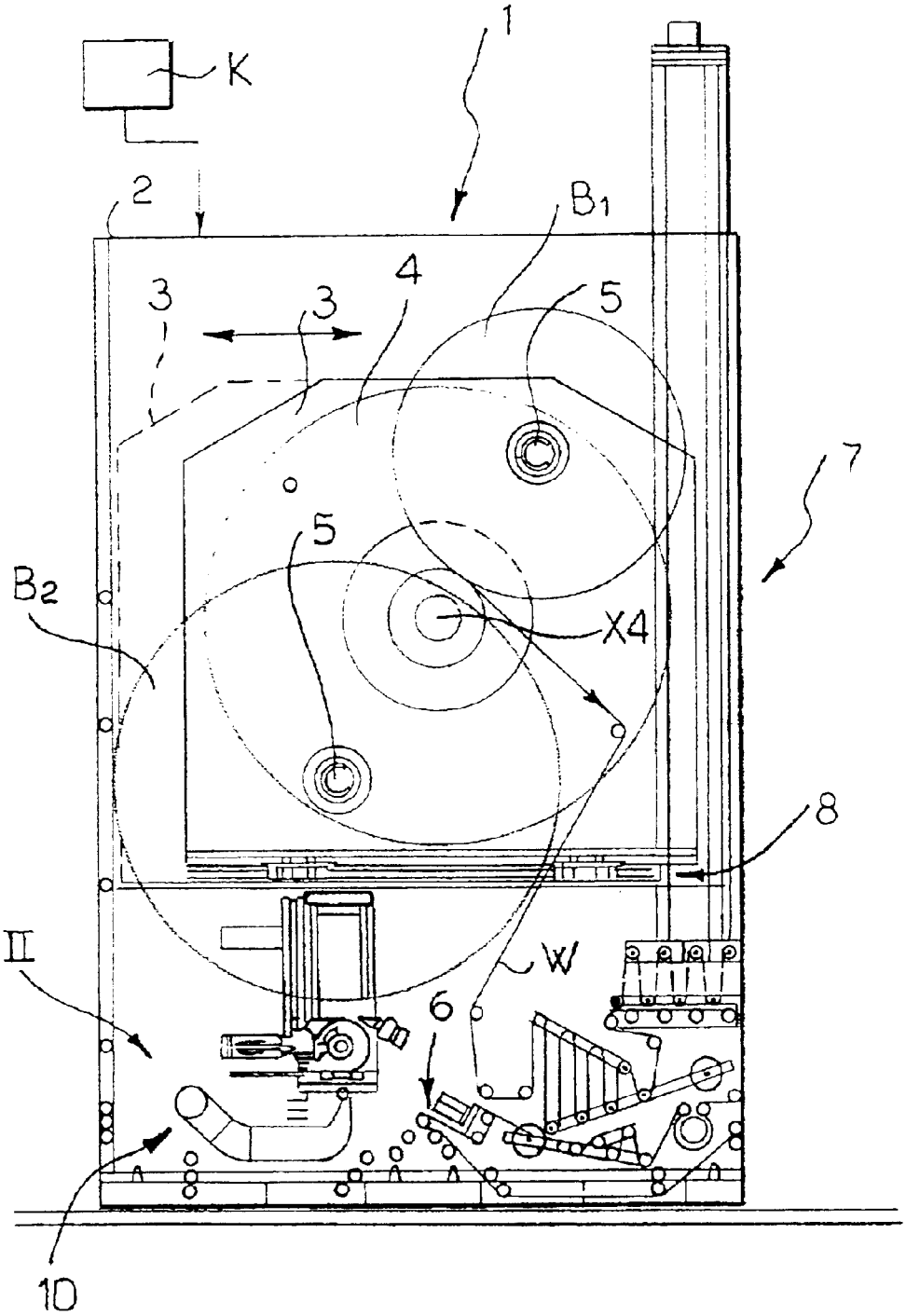
FIG. 1 is a general front elevation of a piece of equipment according to the invention.
Figure 14:
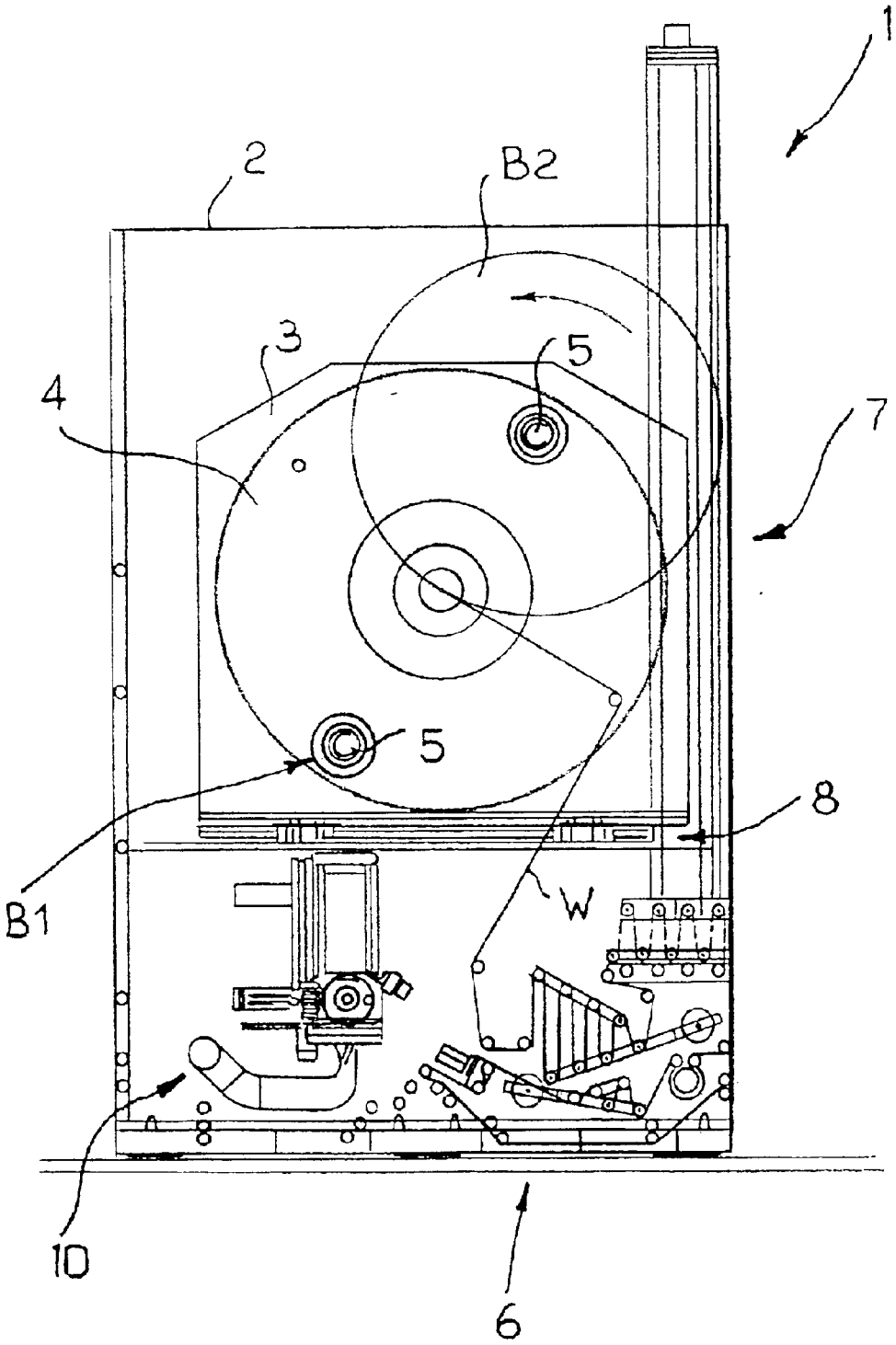
FIG. 14 is a further front elevation of the equipment according to the invention illustrated at the end of an operating cycle.

In FIGS. 1 and 14 of the attached drawings, the reference number 1 designates, as a whole, a machine designed to provide continuous supply of web material. Purely by way of example and without, at the same time, any intention to limit the scope of the invention in any way, the web material may be one that is to be used for making hygienic and sanitary products.

The aforesaid web material is designated, as a whole, by W.

The structure of the equipment 1 is defined by a sturdy frame 2 designed to support all the mechanical, electrical and pneumatic elements that form part of the equipment 1 and render transport, installation and operation thereof possible. The same frame also houses the elements for interconnection to the other modules of the plant of which the equipment 1 forms part.

In particular, the aforesaid plant comprises a control unit K, schematically represented in FIG. 1 alone.

The control unit K may consist, for example, of a so-called programmable logic controller (PLC), a personal computer (PC) or an equivalent processing device that is able to supervise, according to criteria that are in themselves known, operation of the equipment 1 according to the modalities described in what follows.

Mounted on the frame 2 is a turret-type unreeling unit 3. The said unreeling unit carries, in a direction facing the front side of the equipment 1 (the side that is directly visible in the drawings), a wheel or carousel structure 4, which is able to turn about a respective main axis X4, oriented in the horizontal direction. The structure 4 carries, in positions that are diametrically opposed to one another two spindles 5 on which two reels containing web material W are designed to be mounted.

With reference to the relative positions illustrated in FIG. 1, B1 designates the "old" reel from which the web material W at the moment being fed to the equipment using it (equipment not illustrated in the drawings) is reeled off, whilst B2 designates the "new" reel on which is located the web W, a free flap of which must be prepared for splicing to the tail part of the web that is located on the reel B1 when the said reel B1 runs out.

The operation of splicing the tail of the old web (reel B1) to the free end of the new web (reel B2) is carried out in a splicing device (splicer) which is designated, as a whole, by 6. Associated to the device 6 is a unit for accumulating the web, this unit being designated, as a whole, by 7. The purpose of the accumulation unit is to enable the operation of splicing of the web to be carried out in stationary conditions or, in any case, in conditions of slowing-down of the movement of advance of the web material without this being perceived by the stations that use the said material downstream of the equipment.

Both the splicer 6 and the accumulating device 7 are built according to known criteria, and hence are such as not to require a detailed description herein, also because the specific characteristics of these devices are not important for the purposes of understanding or implementation of the present invention. In this connection, reference is again made to the document EP-A-1 013 585 already cited previously.

FIG. 1 once again highlights the fact that, in the currently preferred embodiment of the invention, the turret-type unreeling assembly 3 is mounted on the frame 2 with the possibility of sliding on a set of horizontal guides, designated as a whole by 8.

The aforesaid possibility of sliding, which is indicated by the double-headed arrow at the top of FIG. 1, is designed to enable the unreeling assembly to move between a position of maximum approach (represented by the solid line in FIG. 1) and a position of maximum recession (represented by the dashed line in FIG. 1) with respect to the accumulation unit 7.

The said possibility of displacement is designed to minimize the overall dimensions of the equipment (measured in the direction of the width, as viewed from the point of observation of FIG. 1), given the same size of the reels B1 and B2 loaded, moved and unwound in the equipment 1.

When the equipment 1 is loaded, the reels in question present dimensions that substantially correspond to those of the reel B2 represented, once more, in FIG. 1. Loading of the respective spindle 5 takes place, precisely, in the position represented in FIG. 1 with reference to the reel B2.

In the course of operation of the equipment, the aim will be to cause the carousel structure 4 to rotate gradually so as to bring the reel which at that moment is delivering the web material W into the position represented with reference to the reel B1 in FIG. 1, the purpose being to make the other spindle 5—on which the remainder of the reel used previously is located—available for unloading of said remainder (see also FIG. 14) and for loading of a new reel.

As may be immediately appreciated from FIG. 1, the movement described could bring the reel of material that is being unwound and that is moving downwards to interfere with the accumulation device 7. The possible condition of interference may instead be avoided by selectively causing the unreeling assembly 3 to move backwards towards the position indicated by the dashed line in FIG. 1, then to bring it back forwards into the position illustrated by the solid line, once any risks of interference have been eliminated on account of the reduced diameter of the reel.

The aforesaid movements are controlled by respective motor power drives, of a known type, controlled by the control unit K.

As already mentioned previously, the most important characteristics of the solution according to the invention are primarily linked to the set of elements indicated by the arrow II of FIG. 1. Basically these make up together a set of elements designated as a whole by 10 and designed essentially for fulfilling two main functions:

- formation, in the web material W of the new reel (i.e., with reference to the attached drawings, the reel B2), of a free end or flap starting from which the aforesaid web can be unwound; and
- preparation of said free flap in view of the operation (performed by means of the device 6) of splicing to the tail of the web unwound from the reel that is running out (reel B1 in the attached drawings).

The set of parts making up the device 10 comprises as main element a mobile head 11 made, in the currently preferred embodiment of the invention, in the form of a drum that is able to rotate about its main axis X11. Of course, the mobile head 11 could even have a different shape, for example a polygonal prismatic shape. In the example of embodiment illustrated herein, which, as has been said, is nothing more than an example, the axis X11 is oriented in the horizontal direction and identifies the axis Z of an X-Y-Z Cartesian reference system represented in FIG. 2.

The modalities of movement of the drum 11 basically take two different forms:

- rotation of the drum 11 about its own main axis X11; and
- translation of the drum 11 both in the horizontal direction and in the vertical direction with respect to the frame 2 of the equipment 1. These directions of movement correspond to the axes X and Y of the X-Y-Z reference system illustrated in FIG. 2.

The aforesaid movements of the drum 11 take place under the action of motor means (of a type in itself known) under the control (which is also provided according to criteria in themselves known) of the control unit K. For this reason, the aforesaid motor means are not illustrated in the attached drawings. Likewise, the criteria which, by means of an adequate programming of the control unit K, enable both rotation of the drum 11 about the axis X11 and the general displacement in the plane identified by the axes X and Y (also as a combination of displacements along the aforesaid axes) do not need to be described herein.

At least part of the periphery of the drum 11 is configured in the form of a negative-pressure head 12, which comes under a line of application of subatmospheric pressure which extends through the drum 11 and in particular in the hub of said drum, which rotates about the axis X11.

In this way, the outer surface of the part 12, which has on the whole a tile-like conformation and is oriented in the general direction of the generatrices of the external cylindrical surface of the drum 11, may be selectively made to act as picking-up element to attract to and withhold on itself a sheet-like element, such as, in the specific case and according to the modalities illustrated in greater detail in what follows, a stretch of adhesive tape T1, T2.

The use of suction-type picking-up and retention elements, and the construction of the corresponding lines for supplying subatmospheric pressure, is quite a widespread technique, and in any case a conventional one, in the sector of the processing of sheet materials, for example in automatic packaging plants. The constructional details of the pick-up part 12 and of the corresponding lines for supplying subatmospheric pressure are therefore to be held altogether known to a person skilled in the branch, and hence such as not to require any detailed description herein.

The aforesaid stretches of adhesive tape T1, T2 are supplied by a feed unit 13, also of a conventional type, located on one side of the drum 11 (namely, on the left-hand side in the example of embodiment illustrated) and configured in such a way as to move in the direction of the Z axis so as to apply a corresponding stretch of adhesive tape on the pick-up part 12 of the drum 11.

The movement of supply and application of the adhesive tape is obtained as a result of a relative displacement of the applying assembly 13 in the direction of the Z axis (hence in a direction parallel to the axis X11 of the drum 11).

The length of the stretch of adhesive tape applied of course depends upon the extent of the said relative displacement, which is preferably obtained by keeping the drum 11 stationary and causing the applying assembly 13 to move in the direction of the Z axis.

Application of the adhesive tape T1, T2, which is unwound from a corresponding reel B3 mounted on the applying assembly 13, takes place in such a way that the adhesive layer of the tape is set facing outwards with respect to the drum 11.

The solution according to the invention hence exploits the fact that, whereas the gripping action exerted by a vacuum pick-up head, such as the head 12, is strongly conditioned by the characteristics of the material subjected to the gripping action (depending, for instance, on whether the material is a continuous one or a material with openings or holes, or yet again a material with a marked surface roughness), the gripping action that can be exerted by an adhesive layer is affected to a much smaller extent by the characteristics of the material subjected to the, so to speak, adhesive gripping action, with the added advantage that an adhesive tape presents instead (in particular on its side without adhesive) characteristics of continuity that render it particularly suited to a vacuum gripping action.

In a position generally lower down than those of the drum 11 and of the applying assembly 13, there is located a receiving chute or discard unit 14, which, as will be more clearly seen in what follows, is also connected to a respective pressure line, in such a way as to be able to work as suction inlet for the scrap.

The chute 14 has an inlet 14*a* located immediately beneath the drum 11, in close vicinity to the latter.

Moreover located in a position corresponding to the suction inlet 14*a* is a roller 15, which is mounted in such a way that its axis—also oriented in the horizontal direction, and hence parallel to the axis X11—can be selectively brought up to or moved away from the drum 11. The roller 15 may thus operate as a counter-roller co-operating with the drum 11.

The reference number 16 designates a first cutting device associated to the drum 11. The cutting device 16 (which is able to follow the drum 11 in the movements of translation in the X-Y plane) is located in a position corresponding to the top end of the drum 11 and is designed to co-operate primarily with the web material W which is taken up from the reel B2.

In the currently preferred embodiment of the invention, the cutting device 16 preferably comprises a projecting finger designed to penetrate underneath the loop which, as will be better seen in what follows, is formed in the web material W of the reel B2 as a result of the action of the drum 11. Co-operating with the aforesaid finger there is a rotating blade which turns in a direction such as to draw onto itself the web material W during the cutting operation. The blade performs its cutting action on the web W by moving transversely with respect to the web, and hence by moving in the direction of the Z axis of FIG. 2.

For this purpose, the device 16 is mounted on a moving carriage 16*a*, which, when the cutting device 16 is not active, is located in a position corresponding to one end of the drum 11, in a condition of disengagement with respect to the drum 11 and the web W, which may possibly be co-operating with the drum 11 itself. When the cutting operation is required, the carriage 16*a* is activated by causing it to move in the direction of the Z axis in such a way that its rotating blade performs a movement of transverse sweep of the web W so as to cut it progressively in the direction of its width (Z axis).

The above arrangement has proved particularly advantageous both on account of the efficiency and precision of the cutting action, and because it makes it possible to operate on web materials W having any possible width, by varying accordingly the range of action of the device 16. This result may in fact be simply obtained by programming the control unit K in such a way as to modify the range of travel of the cutting device 16 as required.

Figure 10:
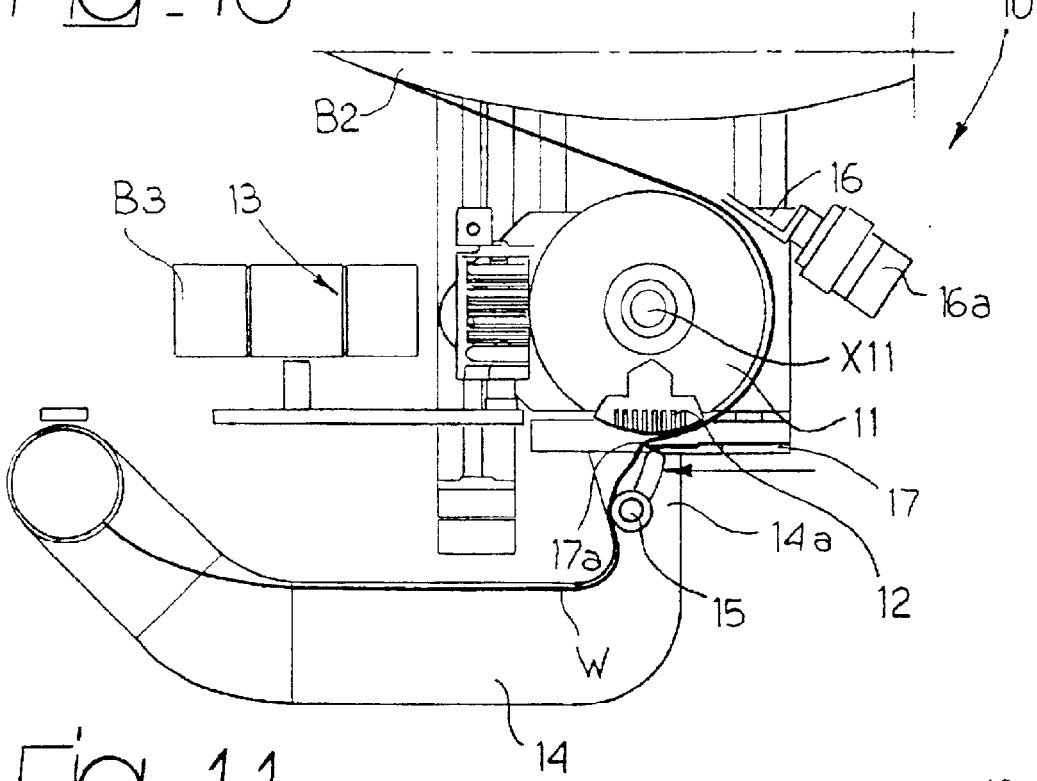
Figure 11:
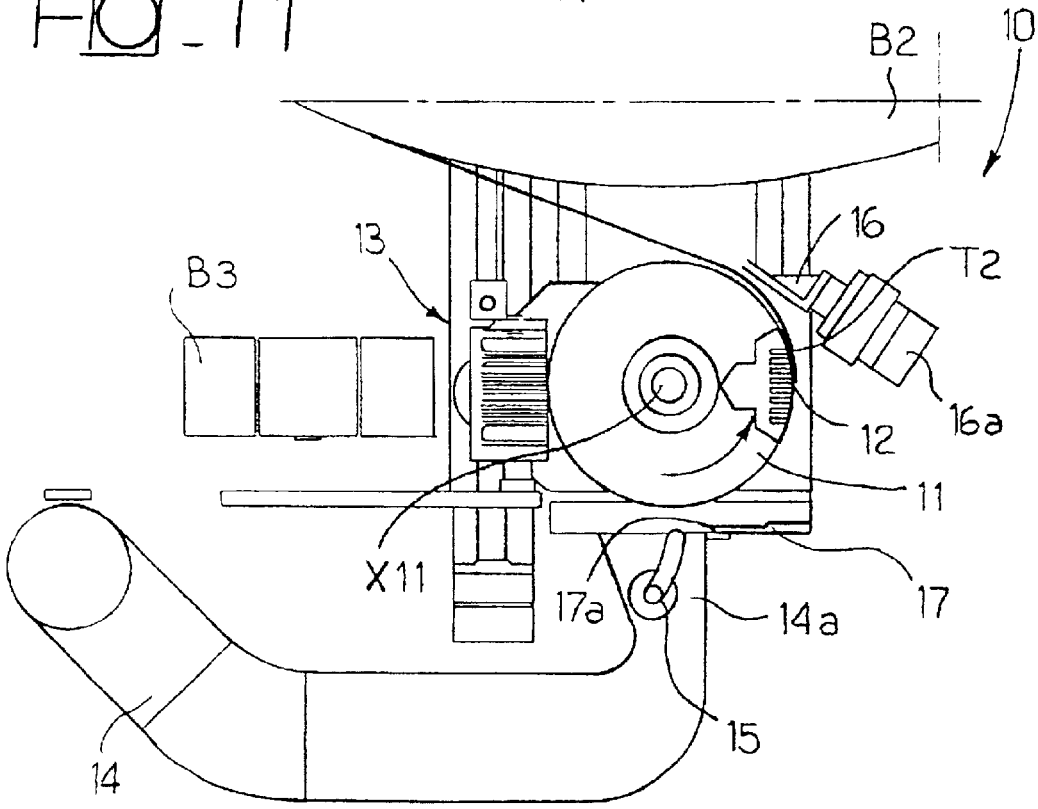
Figure 12:
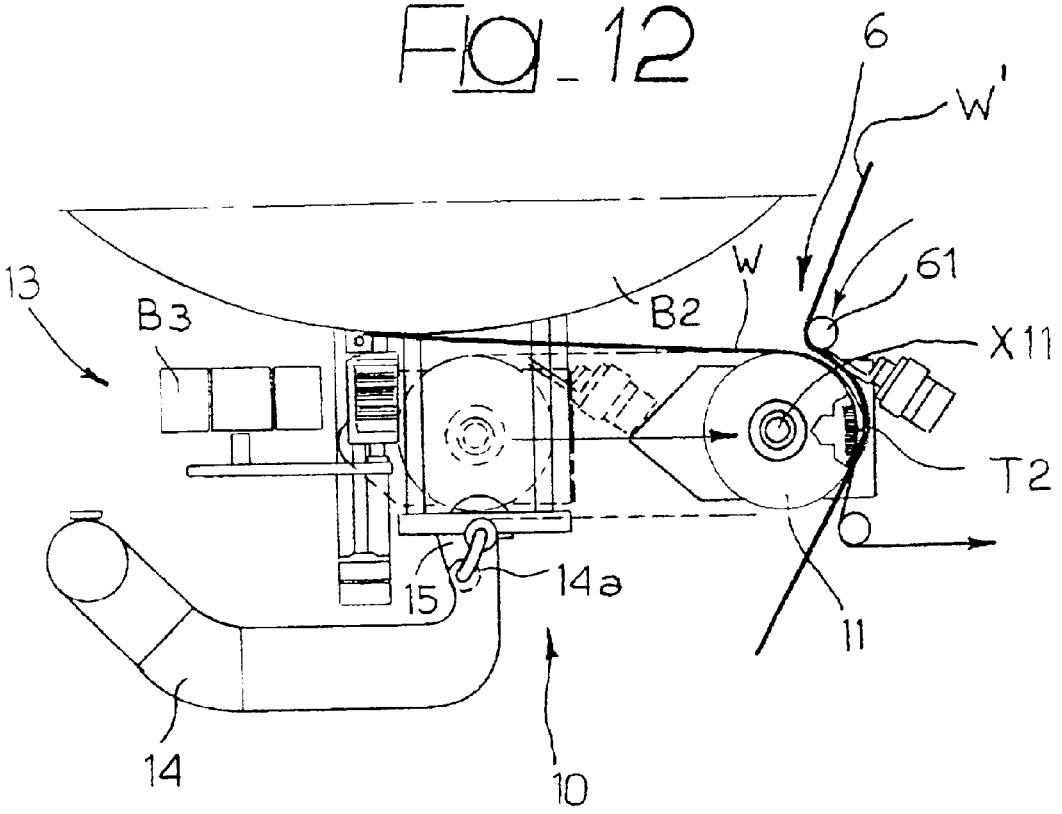
Figure 13:
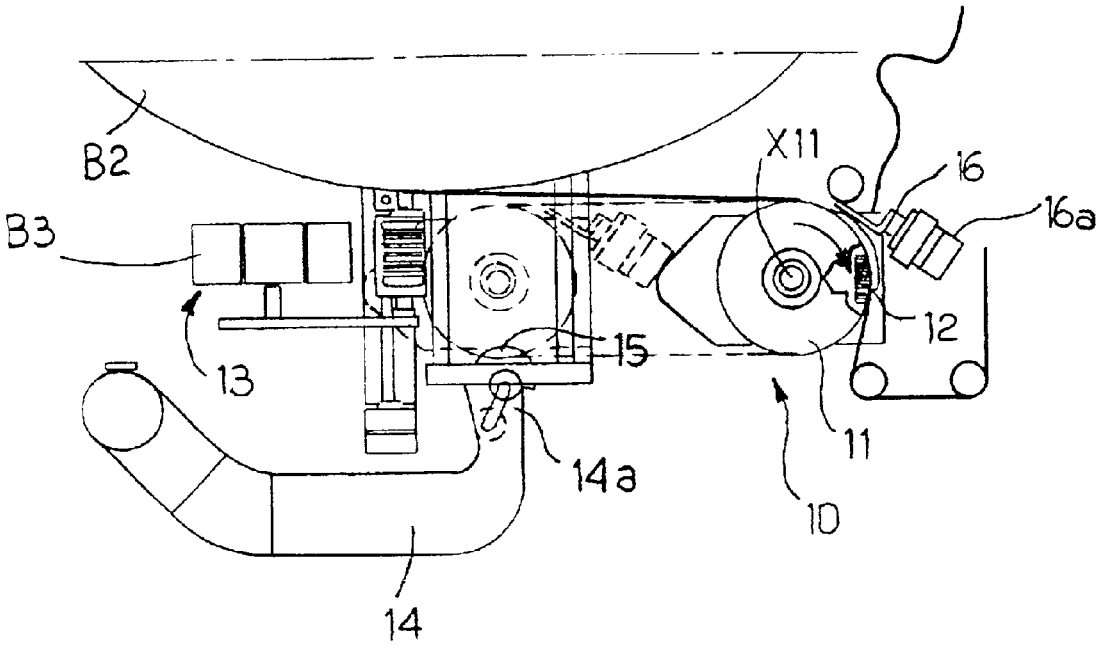

Finally, the reference number 17 designates a further blade cutting device, of a conventional type, represented explicitly only in FIGS. 10 and 11, which precisely refer to the operating steps in which the said device goes into action.

This is preferably—in the case of the cutting device 17—a blade-type cutting element, the cutting edge 17*a* of which extends in the direction of the generatrices of the outer surface of the drum 11. The device 17 is located in a position generally lower than that of the drum 11 in such a way as to be able to perform its cutting operation, which is carried out simultaneously throughout the width of the web material W, in a region roughly corresponding to the region in which the suction inlet 14*a* of the chute 14 and the counter-roller 15 are located.

The operation of the device 10 will now be described with reference to the sequence represented in FIGS. 2 to 13.

It will therefore be assumed that the starting condition of operation is the one represented in FIG. 1, roughly corresponding, as regards the operating cycle of the equipment 1, to the conditions in which:

the equipment 1 is feeding the processing stations situated downstream (not illustrated) with the web material W that is reeled off from the reel B1 (FIG. 1); and the reel B2 has been loaded in the equipment 1 (for example, by means of a special manipulating robot, which is not illustrated but is of a known type) and must be prepared for the change-over operation which is to be carried out when the reel B1 is about to run out; at the same time, a free end or flap to be supplied to the splicer 6 is formed in the web material present on said reel B1.

Figure 2:
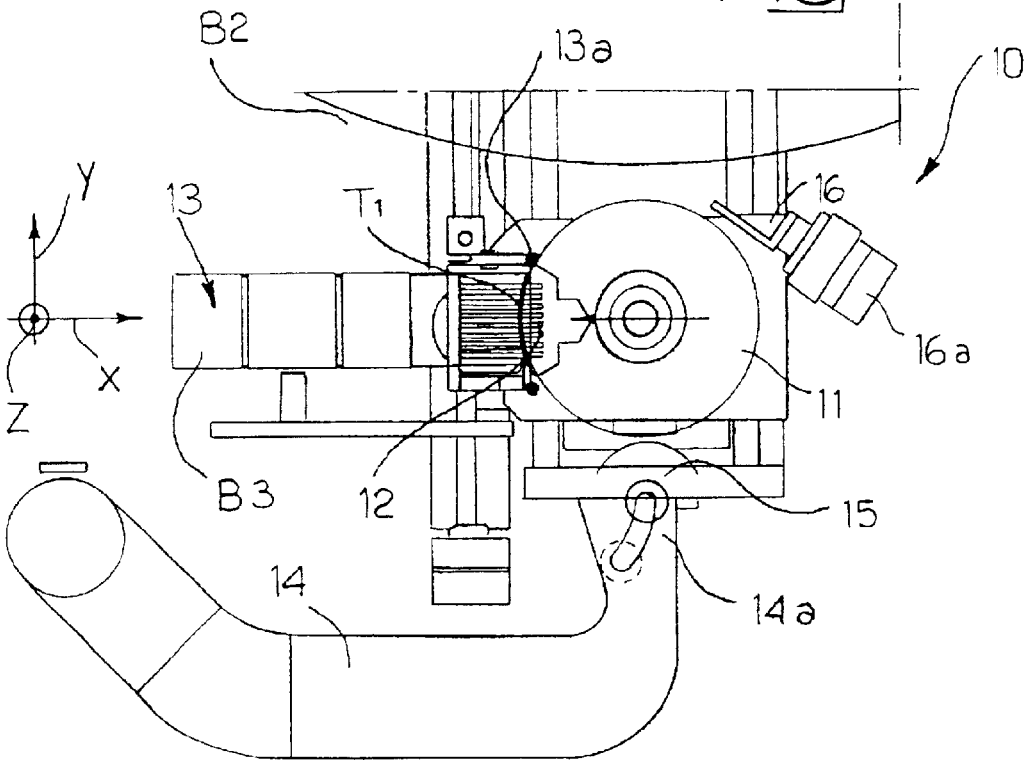
FIGS. 2 to 13 illustrate, with specific reference to the part of FIG. 1 indicated by the arrow II, the modes of operation of the solution according to the invention.
Figure 3:
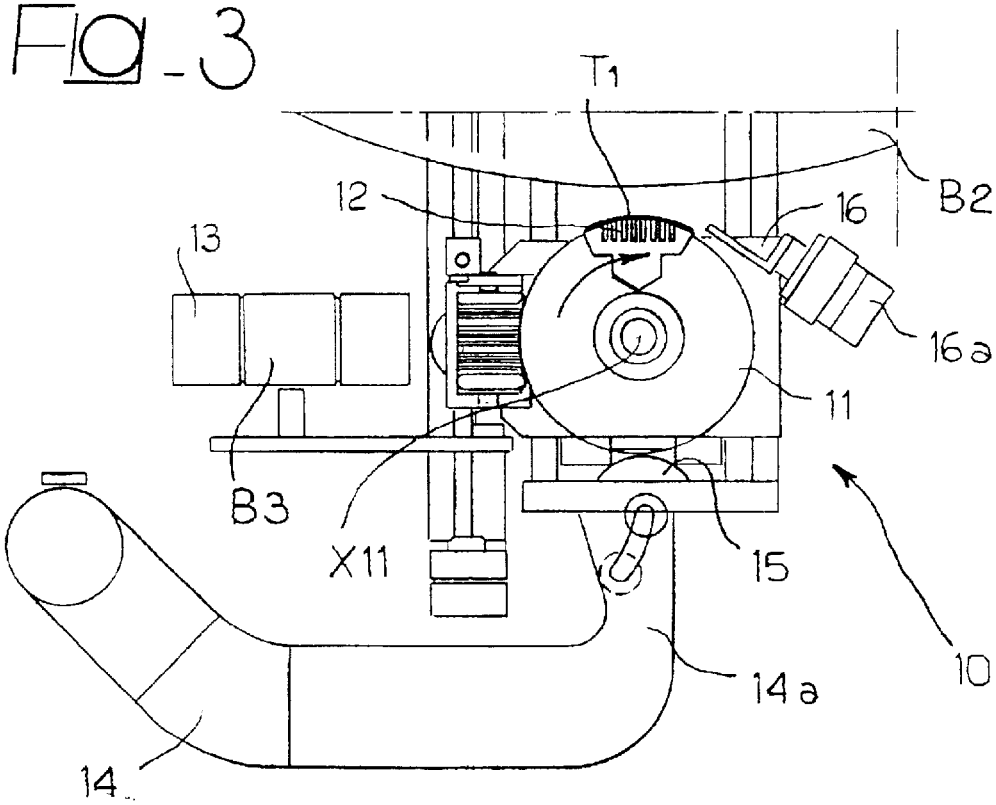
Figure 4:
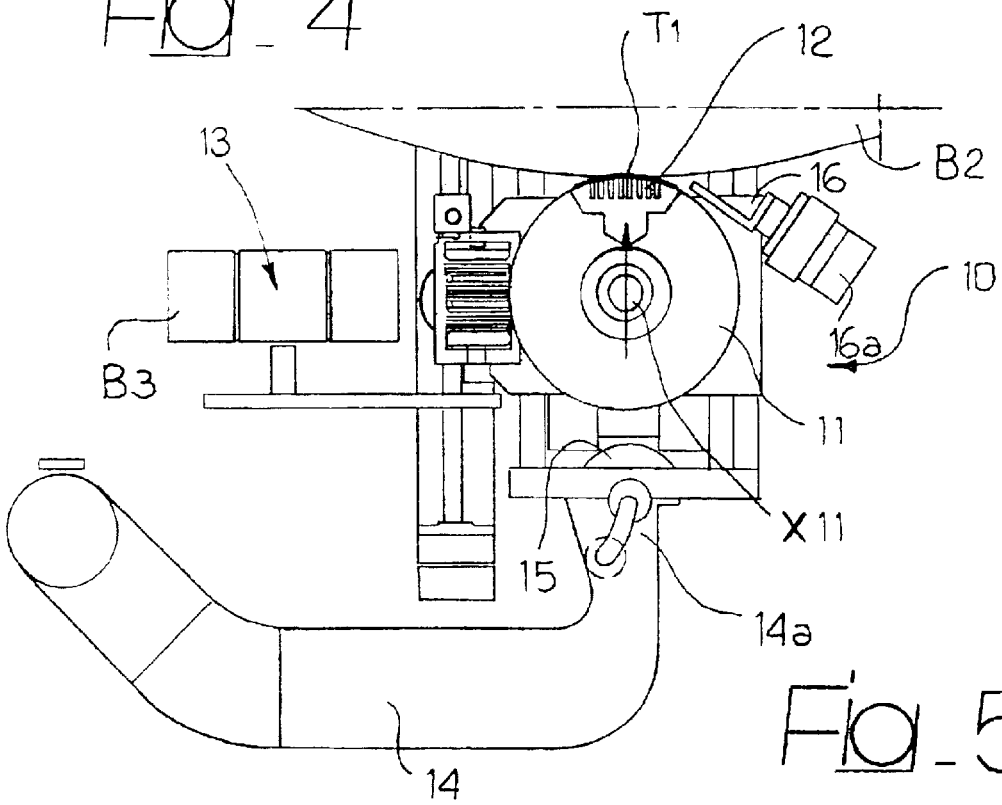

In the operating condition represented in FIG. 2, the drum 11 is positioned in such a way as to be located, with its outer surface, and in particular with its vacuum gripping portion 12, in a position corresponding to the applying assembly or feed unit 13 for feeding the adhesive tape. The feed unit 13 is activated in such a way as to unwind (as a result of its relative movement in the direction of the Z axis with respect to the drum 11) a corresponding stretch of adhesive tape T1 onto the gripping portion 12.

Since the said portion 12 works by suction, the stretch of tape is "captured" and withheld on the surface of the drum 11. At the end of the feed travel of the tape, the corresponding stretch T1 of adhesive tape (with the adhesive layer facing towards the outside of the drum 11) is cut at a given length by a cutting device associated to the unit 13. The said cutting device is of a known type and may, for example, be of the hot-wire type, designated, as a whole, by the reference number 13*a* in FIG. 2 alone.

At this point, the drum 11 moves away from the tape-feed unit 13 and rotates (in the clockwise direction in the example of embodiment illustrated), in such a way as to orient upwards, and hence towards the reel B2, the suction gripping portion 12 and the length of tape T1 that is present on the latter. The condition thus reached is the one illustrated in FIG. 3.

The drum 11 then moves upwards (FIG. 4) in such a way as to cause the length of adhesive tape T1 to adhere to the surface of the outermost turn of the reel B2.

It will be appreciated (also from what will be said in what follows) that the aforesaid operation may be performed at any point of the periphery of the reel B2. The device according to the invention hence does not impose any condition as regards angular positioning of the reel B2 upon loading thereof in the equipment 1.

Figure 5:
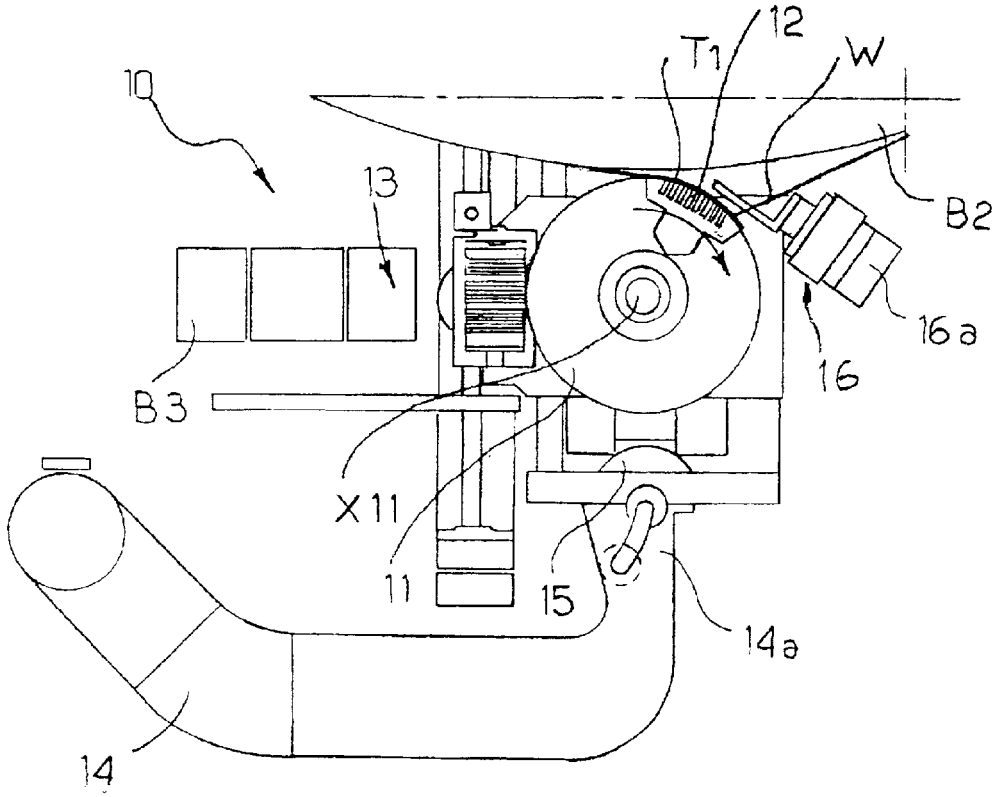
Figure 6:
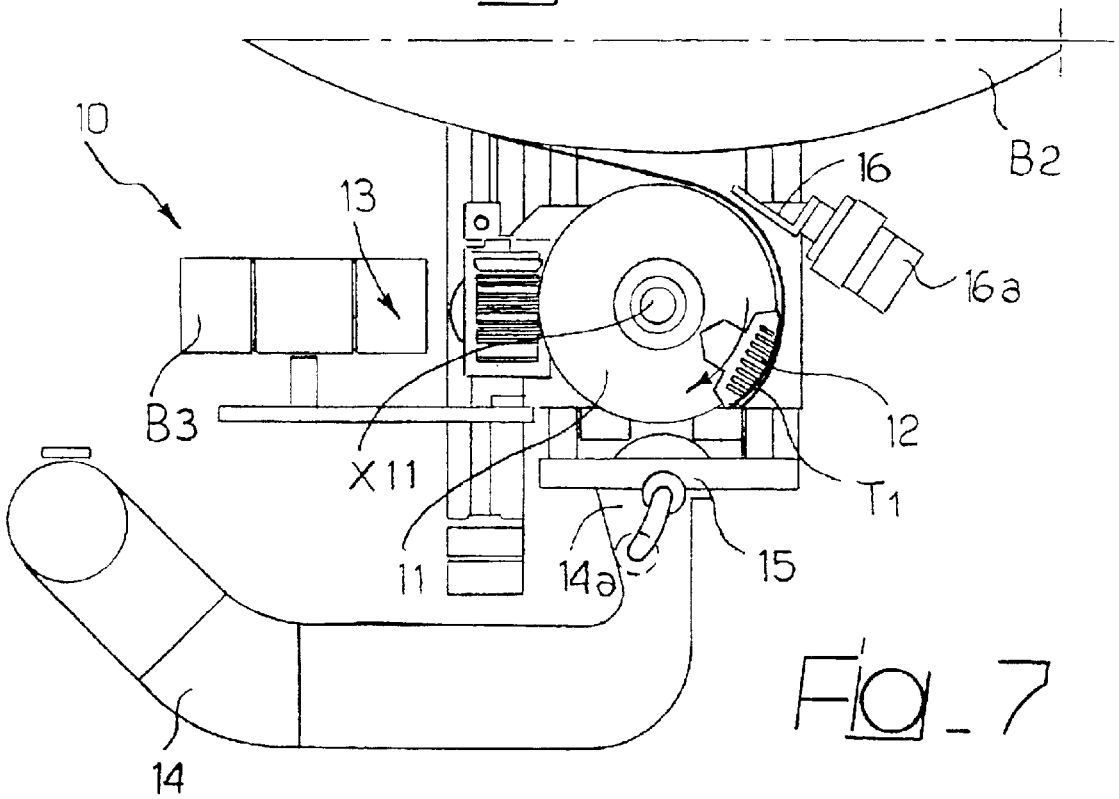

After the stretch of adhesive tape T1 has been applied against the outer surface of the reel B2, so that it therefore adheres to the web material 11, the drum 11 is made to advance at least slightly in its rotation and/or is slightly moved away from the surface of the reel B2, as represented in FIG. 5.

Since the adhesive layer of the length of tape T1 has captured, by adhesion, the web material W of the reel B2 and is in turn withheld on the surface of the drum 11 by the gripping action exerted by the portion 12, the aforesaid movement of rotation and/or recession causes the stretch of web material W engaged by the adhesive tape T1 to move away locally from the body of the reel B2, thus forming a loop of web material, said loop being withheld by the adhesive element T1 and being moved some distance away from the reel B2. The web material W can thus undergo the action of the cutting device 16, which acts on said loop of web material cutting it immediately upstream of the portion captured by the adhesive tape T1.

After the cutting operation (also represented in FIG. 5) is completed, the stretch of adhesive tape T1 constitutes a gripping formation which may be used to obtain unwinding of the web material W from the reel B2. In particular, the drum 11 can proceed with its rotation (in the clockwise direction, with reference to the example of embodiment illustrated) in such a way as to start to draw towards itself a corresponding stretch of web material W (see FIG. 6) until it brings the stretch of adhesive tape T1 into a position in which it faces the counter-roller or contrast roller 15. The latter lifts up and blocks the web material W against the surface of the drum 11, whilst the portion 12 is momentarily supplied with air at a pressure higher than atmospheric pressure. There is thus generated a jet of air such as to deflect the stretch of adhesive tape T1 and the web material W connected thereto inside the suction inlet 14*a* of the chute 14. This operating condition is illustrated in FIG. 7.

The rotating movement of the drum 11 can be maintained for a certain number of revolutions in such a way as to pick up from the reel B the initial turns of the web material W wound on said reel. The corresponding material designed to be discarded is expelled through the chute 14.

Operating in this way there is in any case eliminated the possible "dead" stretch of web material W that may be formed between the free flap or end of the turn originally present on the reel B2 and the point in which the cutting operation has been performed by the device 16.

Figure 7:
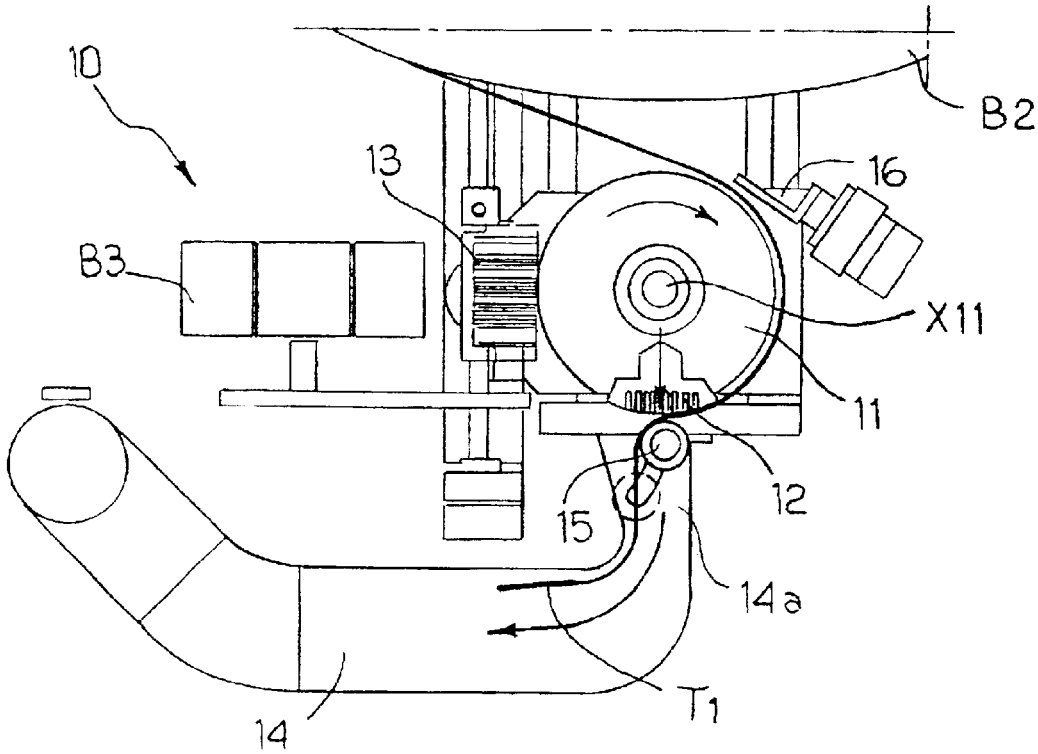
Figure 8:
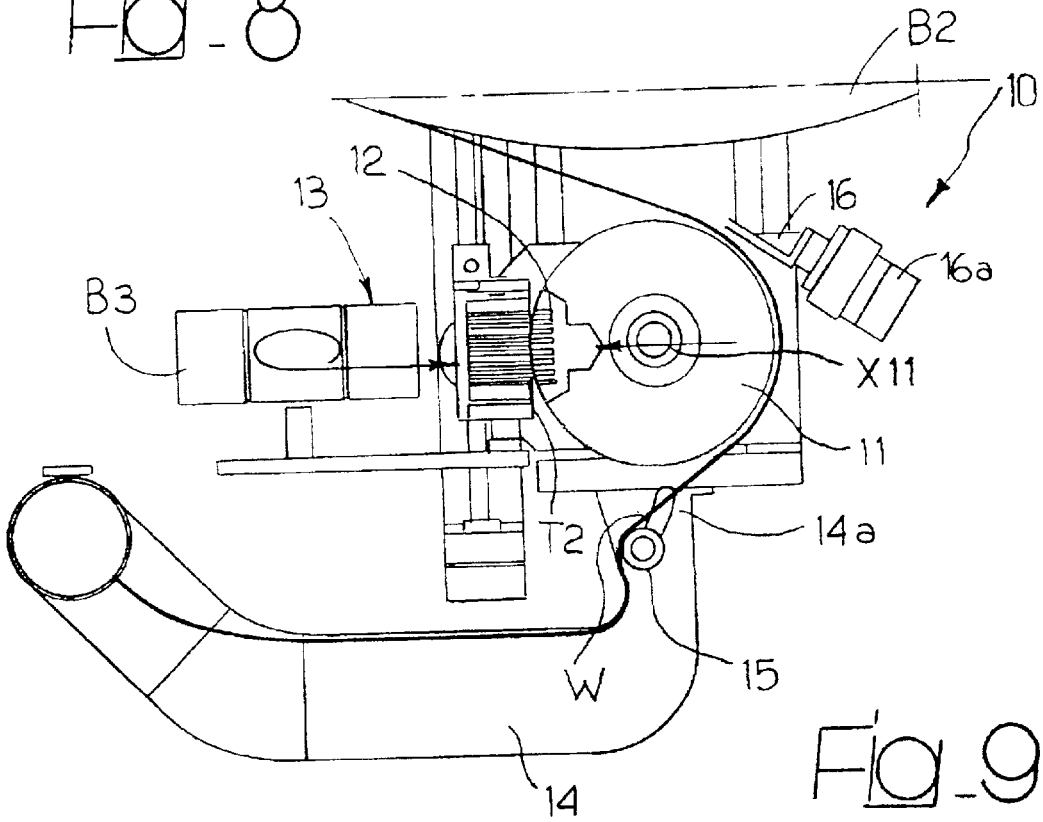

After the operating condition represented in FIG. 7 has carried on for a certain period of time, the condition represented in FIG. 8 is reached (again as a result of a corresponding control action performed by the control unit K).

In these conditions, the web material W coming from the reel B2 winds onto the side of the drum 11 opposite to the tape-feed device 13 and is then inserted into the inlet 14*a* of the chute 14, passing on the surface of the roller 15 which is now kept at a slight distance away from the drum 11.

The drum 11 is then brought back again into the condition in which the vacuum gripping portion 12 is set facing the tape-feed device 13.

According to modalities altogether similar to the ones described previously with reference to the supply of the stretch of tape T1, the tape-feed device 13 supplies a new stretch of adhesive tape T2, depositing it on the portion 12 of the drum 11. Also in this case, the adhesive layer of the stretch of adhesive tape T2 is set facing towards the outside of the drum 11, while the stretch of tape T2 is withheld on the surface of the drum 11 as a result of the vacuum-gripping action carried out by the suction portion 12.

Figure 9:
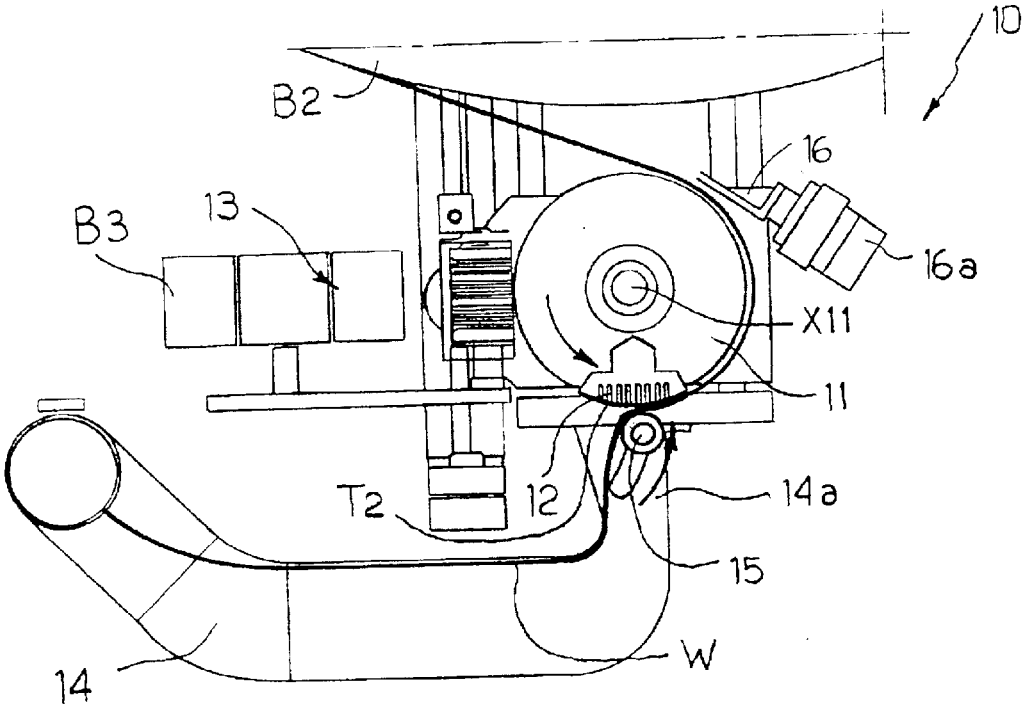

At this point, passing on to the operating condition represented in FIG. 9, the drum 11 is made to rotate (this time in the counter-clockwise direction) in such a way as to bring the suction gripping portion 12 and the stretch of tape T2 applied thereon so that they face downwards in a position immediately above the roller 15. The latter is raised so as to bring the stretch of web material W resting thereon to adhere to the adhesive layer of the stretch of tape T2.

In this case, however, the adhesive connection does not involve the entire extent of the tape T2, but approximately just one half thereof.

In other words, the web material W is made to adhere to the tape T2 only in an initial portion, which is proximal with respect to the development of the web material W gathered on the reel B2. The other half of the adhesive surface of the stretch of tape T2, which is distal with respect to the development of the web, is, instead, left uncovered and separate from the web material W.

At this point (see FIG. 10), the blade cutting device 17 goes into action. The position and range of action of the device 17 are adjusted in such a way that the web material W is cut in close proximity to the area in which the web material W drops downwards inside the chute 14, moving away from the surface of the drum 11, and hence away from the adhesive surface of the stretch of tape T2. In other words, the device 17 acts in a position intermediate between said first portion and said second portion, respectively proximal and distal, of the stretch of adhesive tape T2.

The stretch of web W separated from the reel B2 as a result of the operation of the cutting device 17 is ejected through the chute 14.

In this way, in the web material W which is gathered on the reel B there is formed a free end or flap on which the stretch of tape T2 is applied which, in one first part, which is proximal, is connected to the said free end, and for one second part, which is distal, is set with its adhesive layer facing the outer surface of the drum 11.

In these conditions, the drum 11 itself may be made to turn in the counter-clockwise direction in such a way as to reach the condition illustrated in FIG. 11, in which the aforesaid free end of the web material, including the stretch with adhesive corresponding to the stretch of tape T2, is set facing the splicer 6. Of course, since the free end of the web material W follows the drum 11 in the aforesaid movement, means are provided for preventing the undesired formation of loose loops in the web. This result may be obtained, for instance, by acting on the drive of the spindle 5 that carries the reel B2 in such a way as to cause a slight return of the web material W onto the reel to an extent sufficient to maintain the stretch of web that extends from the reel B2 to the drum 11 tensioned.

At this point, the web material of the reel B2 is ready for the splicing operation.

This is carried out according to criteria that are, on the whole, known.

In particular, the control unit K monitors (by sensor means in themselves known) gradual unwinding of the reel B1 (FIG. 1) in such a way as to identify the step in which the flying-change operation is to be performed, i.e., the operation whereby the free leading end of the reel B2 is connected to the tail end of the reel B1 which is in the process of running out.

As the moment of change-over approaches, the control unit K issues a command for entry into action of the accumulation device 7 in such a way as to form on the latter an accumulation or supply of web material W sufficient to ensure, during the change-over operation, feeding of the equipment located downstream.

Once the equipment 1 has been thus arranged, at start-up of the change-over operation the control unit K controls the accumulation device 7 in such a way that the latter starts delivering the material accumulated thereon, while the reel B1 is slowed down and practically brought to a stop.

At this point, a roller 61 of the splicing device 6 (see FIG. 12) takes the "mold" web, designated by W' and coming from the reel B1 that is running out, towards the splicing area. At the same time, the drum is made to advance towards the splicing area, as schematically illustrated again in FIG. 12. The movement of advance of the drum 11 causes the stretch of adhesive tape T2 to adhere to the surface of the web material W', thus achieving connection between the "old" web W' which is being unwound from the reel B1 and the "new" web W that is taken up from the reel B2. The coupling roller 61 strengthens the spliced joint between the two stretches of web material, whilst the drum 11 rotates slightly in such a way as to obtain perfect adhesion of the adhesive tape and at the same time to bring (see FIG. 13) the old web W' into the working area of the cutting device 16, which now cuts it definitively.

Movement of the web into the position corresponding to the reel B2 is now gradually restarted, whilst the amount of web material supplied by the accumulation device 7 reduces accordingly. This situation lasts until the aforesaid supply ceases and the equipment downstream is again fully fed with web material W taken up from the reel B2. As already mentioned, restarting of the action of supply of web from the reel B2 is carried out gradually and in a way that is coordinated with the conclusion of the phase of intervention of the accumulation device 7, in such a way as to avoid exerting excessive tensile stress on the web material.

In this phase, when the diameter of the reel B2 so requires, the unwinding unit 3 translates horizontally on the guides 8 in such a way that, during rotation of the wheel 4 designed to bring the reel B2 gradually upwards and to cause what remains of the reel B1 to move downwards, the lateral dimension of the equipment 1 (i.e., its overall encumbrance) will not be exceeded.

The position represented in FIG. 14 is thus reached, in which the reel B2 has come to occupy the position previously occupied by the reel B1, whilst what remains of the reel B1 can be removed from the equipment 1, for example as a result of a movement of automatic ejection performed by the spindle 5 itself.

At this point, a new reel can be loaded on the spindle 5, thus giving rise to a new change-over cycle according to the procedure previously illustrated.

Of course, without prejudice to the principle of the invention, the details of construction and the embodiments may vary widely with respect to what is described and illustrated herein, without thereby departing from the scope of the present invention as defined in the ensuing claims. For example, in addition or as an alternative to the tile-like gripping formation 12 illustrated in the attached drawings, the drum element 11 may be provided with suction gripping elements which can perform a particularly forceful gripping action on the adhesive material T1. These may be, for example, sucker-type gripping formations usable for gripping the adhesive element T1 in such a way as to promote the formation of a loop in the tape that is separated from the reel, after the adhesive element T1 itself has been deposited on the surface of the reel on which the material to be picked up is accumulated. This possible variant embodiment is preferential for those applications in which the web material W is somewhat stiff and/or is wound somewhat tightly on the corresponding reel.

What is claimed is:

1. A process for picking up a material by acting on one surface of the same, comprising the operations of:

providing web material wound on a reel;

providing an adhesive element;

applying said adhesive element on the external surface of the reel in such a way as to establish adhesive connection with said material itself;

picking up said material by acting on said adhesive element;

producing a relative movement between said adhesive element and said reel in such a way as to determine the formation of a loop of web material withheld by said adhesive element and at a distance from said reel; and cutting said web material at a point corresponding to said loop, so that said adhesive element may be used as a pick-up formation to determine unreeling of said web material from said reel.

2. The process of claim 1, wherein said relative movement involves a movement of rotation of said adhesive element with respect to said reel.

3. The process of claim 1, wherein said relative movement involves a movement of relative recession between said adhesive element and said reel.

4. The process of claim 1, comprising the operations of:

unreeling a certain stretch of said web material from said reel using said adhesive element as pick-up formation;

discarding at least one portion of said web material on which said adhesive element is applied;

providing a further adhesive element on said web material, causing said further adhesive element to have:

a first portion, which is proximal in the direction of unreeling of said web material from said reel and which is adhesively connected to said web material; and a second portion, which is distal in the direction of unreeling of said web material from said reel and which is separated from said web material; and cutting said web material between said first portion and said second portion of said further adhesive element, so that said second portion of said further adhesive element constitutes an adhesive formation for connection of said web material to a homologous web material.

5. The process of claim 4, comprising the operation of connecting said web material to a homologous web material using said second portion of said further adhesive element.

6. The process of claim 4, comprising the operation of cutting said web material between said first portion and said second portion of said further adhesive element with a cutting action exerted simultaneously throughout the width of said web material.

7. The process of claim 4, comprising the operation of withholding said further adhesive element by means of an action of vacuum retention.

8. The process of claim 1, comprising the operation of cutting said web material at a point corresponding to said loop with a cutting action exerted progressively in the direction of the width of the web material.

9. The process of claim 1, comprising the operations of forming said adhesive element and said further adhesive element by unwinding a reel of adhesive tape in the direction transverse to said web material.

10. The process of claim 1, comprising the operation of withholding said adhesive element by means of an action of vacuum retention.

11. A device for picking up a web material by acting on one surface thereof, comprising:

a reel having said web material wound thereon;

a source for supplying adhesive elements; and a pick-up element for receiving said adhesive elements from said source and applying the adhesive elements on the surface of said web material so as to establish an adhesive connection to the web material itself, said pick-up element thus performing picking-up of said web material by acting on said adhesive elements, said source supplying adhesive elements having a substantially continuous surface, and said pick-up element comprising a vacuum pick-up formation that is able to act on said substantially continuous surface of said adhesive elements;

a supporting structure for supporting said reel with respect to which said pick-up element is able to perform a relative displacement so as to determine, in use, with said reel mounted on said supporting structure, the formation of a loop of web material withheld by one of said adhesive elements and held at a distance from the reel; and a cutting element for cutting said web material at a point corresponding to said loop, so that said adhesive element may be used as a pick-up formation to determine unreeling of said web from said reel.

12. The device of claim 11, wherein said pick-up element is a rotary element, so that said relative displacement involves a movement of rotation of said pick-up element.

13. The device of claim 11, wherein said pick-up element is able to perform a movement of recession with respect to said structure for supporting the reel, so as to perform said relative movement.

14. The device of claim 11, wherein said pick-up element is able to act in a relationship of application of a tensile force on said adhesive elements that are applied on said web material for determining unreeling of said web material from the reel for a certain stretch; and wherein:

a unit is provided for selectively discarding of at least one portion of web material on which said adhesive element has been applied;

said supply source is configured to supply further adhesive elements;

said pick-up element is configured to receive said further adhesive elements and to apply them on said web material, causing said further adhesive elements to have a first portion, proximal in the direction of unreeling of said web material from said reel, that is adhesively connected to said web material, and a second portion, distal in the direction of unreeling of said web material from said reel, that is separated from said web material; and a further cutting element is provided for cutting said web material between said first portion and said second portion of said further adhesive elements, so that said second portion of said further adhesive elements constitutes an adhesive formation for adhesive connection of said web material to a homologous web material.

15. The device of claim 14, further comprising a splicing device for adhesively connecting said web material to said a homologous web material using said further adhesive elements.

16. The device of claim 15, wherein said splicing device is located in a lateral position with respect to said pick-up element.

17. The device of claim 16, wherein said pick-up element is capable of a general movement of relative approach to said splicing device.

18. The device of claim 14, wherein said further cutting element comprises a blade that is able to perform a cutting action that involves said web material simultaneously throughout its width.

19. The device of claim 14, wherein said discard unit is located in a position generically lower than said pick-up element.

20. The device of claim 14, wherein said discard unit has a feed inlet located in the vicinity of said pick-up element.

21. The device of claim 14, wherein said discard unit is a discard unit with suction action.

22. The device of claim 11, wherein said cutting element comprises a blade that is capable of a progressive cutting movement in the direction of the width of said web material.

23. The device of claim 22, wherein said cutting element comprises a rotating blade.

24. The device of claim 23, wherein said rotating blade rotates in a direction such as to draw onto itself said web material.

25. The device of claim 11, wherein said source for supplying adhesive elements comprises a device for supplying adhesive tape capable of performing a relative movement with respect to said pick-up element so as to deposit on said pick-up element stretches of adhesive tape of a selectively determined length.

26. The device of claim 11, wherein said source supplies tape which has adhesive on one of its faces, and in that said further adhesive elements are received on said pick-up element with said adhesive surface facing the outside of the pick-up element itself.

27. The device of claim 11, wherein said source supplies tape which has adhesive on one of its faces, and wherein said further adhesive elements are received on said pick-up element with said adhesive surface facing the outside of the pick-up element itself.

28. The device of claim 11, wherein said pick-up element comprises a drum rotating about a respective axis.

29. The device of claim 28, wherein said pick-up element is capable of performing movements of translation in a plane generically orthogonal to said axis of rotation.

30. The device of claim 11, wherein said structure for supporting said reel is located in a position generically higher than said pick-up element.

31. The device of claim 11, wherein said source for supplying adhesive elements is located in a lateral position with respect to said pick-up element.

32. The device of claim 31, wherein said splicing device is located in a lateral position with respect to said pick-up element and wherein said supply source and said splicing device are located on opposite sides of said pick-up element.

33. The device of claim 31, wherein said pick-up element is capable of a general movement of relative approach to said splicing device and wherein said supply source and said splicing device are located on opposite sides of said pick-up element.

34. The device of claim 11, wherein said pick-up element comprises a surface portion that is able to be brought to a level of subatmospheric pressure so as to apply an action of vacuum retention on said adhesive elements and/or said further adhesive elements.

35. The device of claim 34, wherein said portion has a general tile-like conformation.

36. The device of claim 35, wherein said pick-up element has a general cylindrical configuration, and said portion extends in general in the direction of the generatrices of said cylindrical surface.

37. The device of claim 11, comprising a frame having a volume of pre-determined overall dimensions, and wherein said structure for supporting the reel also supports a second reel on which a homologous web material is wound, said structure being mounted on said frame with a general capacity of movement, the arrangement being such that said reels may be kept constantly within the volume of overall dimensions defined by said frame.

38. The device of claim 11, wherein said supporting structure comprises:

a carousel part provided with distinct supporting elements for said reel and for a second reel on which a homologous web material is wound, the arrangement being such that one of said reels may be subjected to the action of said pick-up element, whilst the other of said reels ensures supply of said web material.

39. The device of claim 11, comprising a frame having a volume of pre-determined overall dimensions, and wherein said structure for supporting the reel also supports a second reel on which a homologous web material is wound, said structure being mounted on said frame with a general capacity of movement, the arrangement being such that said reels may be kept constantly within the volume of overall dimensions defined by said frame, and said supporting structure is configured for enabling automatic ejection of whatever remains of said reels once they have run out as a result of the fact that all the web material has been delivered.

40. The device of claim 11, wherein said supporting structure comprises:

a carousel part provided with distinct supporting elements for said reel and for a second reel on which a homologous web material is wound, the arrangement being such that one of said reels may be subjected to the action of said pick-up element, whilst the other of said reels ensures supply of said web material, and said supporting structure is configured for enabling automatic ejection of whatever remains of said reels once they have run out as a result of the fact that all the web material has been delivered.

* * * * *